US006526249B2

(12) United States Patent
Takahashi

(10) Patent No.: US 6,526,249 B2
(45) Date of Patent: Feb. 25, 2003

(54) COLOR IMAGE FORMING APPARATUS AND COLOR IMAGE FORMING METHOD THEREOF

(75) Inventor: Tetsu Takahashi, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 0 days.

(21) Appl. No.: 09/791,792

(22) Filed: Feb. 26, 2001

(65) Prior Publication Data

US 2002/0034407 A1 Mar. 21, 2002

(30) Foreign Application Priority Data

Sep. 5, 2000 (JP) ..... 2000-268584

(51) Int. Cl.[7] ..... G03G 15/01
(52) U.S. Cl. ..... 399/303; 399/312
(58) Field of Search ..... 399/298, 299, 399/306, 312, 303

(56) References Cited

U.S. PATENT DOCUMENTS 5,602,633 A * 2/1997 Yoshida et al. ..... 399/244
5,659,842 A 8/1997 Hasegawa et al.
5,907,758 A 5/1999 Tanaka et al.
6,021,286 A 2/2000 Kawai et al.

FOREIGN PATENT DOCUMENTS

| | | | |
|---|---|---|---|
| JP | 62-63972 | | 3/1987 |
| JP | 3-186877 | | 8/1991 |
| JP | 8-160775 | | 6/1996 |
| JP | 9-15984 | * | 1/1997 |

* cited by examiner

*Primary Examiner*—Quana M. Grainger
(74) *Attorney, Agent, or Firm*—Armstrong, Westerman, & Hattori, LLP

(57) ABSTRACT

Disclosed a tandem type color image forming apparatus and a color image forming method to reduce the cost of production without lowering the transfer efficiency. An electric potential setting member (170) is disposed in the tandem color image forming apparatus. The electric potential setting member (170) sets the electric potential difference between the front and back faces of a dielectric belt (160) in tandem image forming units (110 to 140) to approximately 0V before a transfer material (100) is adsorbed. This enables the electric potential difference between the front and back faces of the dielectric belt (160) in the respective color transfer positions to be set to approximately 0V. Therefore, there is a wide range of selecting the dielectric belt types, and the lowering of the transfer efficiency can be prevented, which is caused by the lowering of the resistance value of the dielectric belt surface after running.

12 Claims, 6 Drawing Sheets

COLOR IMAGE FORMING APPARATUS AND COLOR IMAGE FORMING METHOD THEREOF

BACKGROUND OF THE INVENTION

1. Field of the Invention

The present invention relates to a color image forming apparatus for forming a color image on a sheet by using toners, and a color image forming method there of, and more particularly to a color image forming apparatus which has a tandem type engine arranged a plurality of toner image forming units, and a color image forming method thereof.

2. Description of the Related Art

A tandem type color image forming apparatus as a color image forming apparatus, which has a plurality of toner image forming units parallel-disposed in a carrying path thereof, continuously forms the toner images with different colors on a sheet to enable a high-speed printing. FIG. 7 shows a conventional tandem type color electro-photographic apparatus.

In FIG. 7, reference numbers 10, 20, 30 and 40 indicate the OPC (Organic Photoconductor) drums of the Yellow-color, Magenda-color, Cyan-color, and Black-color toner process units, respectively. The electrostatic latent images are formed on the OPC drums 10,20,30 and 40 and developed with Yellow-color, Magenda-color, Cyan-color, and Black-color toners by the unshown developing members in the Yellow-color, Magenda-color, Cyan-color, and Black-color toner process units.

The developed toners are transferred onto a sheet 100 by the strength of an electric field, which has been generated between the OPC drums 10 to 40 and the sheet 100 by a voltage applied from transfer members 80 to 84 such as transfer rollers, etc. The sheet 100 is electrically charged by a sheet adsorption roller 60, and then it is adsorbed onto a dielectric belt 50.

The sheet 100 is carried to the transfer positions of the OPC drums 10, 20, 30, and 40 by the movement of the dielectric belt 50, and all of the four colors are transferred onto the sheet 100. Then, the sheet 100 is taken off the dielectric belt 50, and the toner images on the sheet 100 are fixed by an unshown fixing member. Even when the four colors are transferred at different positions, the dielectric belt 50 adsorbs the charged sheet 100, so that a high-quality color image can be formed without a position deviation of each color on the sheet 100.

As disclosed in U.S. Pat. No. 5,907,758 (Japanese Unexamined Published Patent 10-198120), and U.S. Pat. No. 6,021,286 (Japanese Unexamined Published Patent 11-161035), etc., in a conventional tandem type color electro-photographic process, the dielectric belt 50 is charged to a high electric potential such as approximately 1000V by a charging device 70. The reason why the dielectric belt 50 is charged to the high electric potential is explained. An electric potential difference between the sheet 100 and the OPC drums 10 to 40 can be increased for the charged electricity of the dielectric belt 50, even when the transfer voltage applied to the four color toner transfer members 80, 81, 82, and 83 is lowered. The strength of the electric field generated between the sheet 100 and the OPC drum is caused by increasing the potential difference between the sheet 100 and the OPC drum to a degree that no electric discharge occurs, so that the transfer efficiency can be improved.

The above process is explained below, taking an example. The conductive brush 70 charges the dielectric belt 50 to 1000V. At the same time, the sheet adsorption roller 60 charges the sheet 100 to adsorb the sheet 100 onto the dielectric belt 50. At this time, the sheet 100 must be charged so that the potential difference between the front and back faces of the sheet 100 can be set to 2000V.

Then, the Yellow-color toners contained in the OPC drum 10 are transferred onto the sheet 100 in the Yellow-color toner transfer position. A voltage of −100V (direct current) is applied to a transfer roller 80. At this time, electric charges on the sheet move to a photosensitive body 10. Therefore, the potential difference between the front and back faces of the dielectric belt 50 is lowered from 1000V to 400V.

Then, the Magenda-color toners contained in the OPC drum 20 are transferred onto the sheet 100 in the Magenda-color toner transfer position. A voltage of 500V (direct current) is applied to a transfer roller 82. At this time, the electric charges move to a photosensitive body 20. Therefore, the potential difference between the front and back faces of the dielectric belt 50 is lowered from 400V to 200V.

Then, the Cyan-color toners contained in the OPC drum 30 are transferred onto the sheet 100 in the Cyan-color toner transfer position. A voltage of 700V (direct current) is applied to a transfer roller 83. At this time, the electric charges move to a photosensitive body 30. Therefore, the potential difference between the front and back faces of the dielectric belt 50 is lowered from 200V to 0V.

Finally, the Black-color toners contained in the OPC drum 40 are transferred onto the sheet 100 in the Black-color toner transfer position. A voltage of 900V (direct current) is applied to a transfer roller 84.

In the above sequential transfer process, the potential difference between the surfaces of the sheet 100 and the photosensitive bodies 10 to 40 is always maintained at 1200V to obtain an even transfer efficiency.

However, viewing from the characteristics of the dielectric belt, it is necessary to keep the charge carrying function to lower the transfer voltage until at least the four-color transfer process is completed, so the resistance value of the dielectric belt must be high and constant. Therefore, the dielectric belt needs to be selected in a limited and permissible range, so that there is a problem that it is difficult to lower the apparatus cost.

It is known that when the running (printing) operation is executed to some degree, the surface-resistance on the dielectric belt as well as the electric charge carrying ability of the dielectric belt are lowered by the adsorption of impurities such as toners, etc. For example, FIG. 8 shows the result of measuring the electric potential fluctuations on the dielectric belt surface for the time (seconds) when a new dielectric belt (New Belt) before running and an old dielectric belt (Old Belt) after running during a specific time are charged to about 900V.

It is judged from this result that the electric charge carrying ability of the dielectric belt has been lowering. When the dielectric belt with the material characteristics in FIG. 8 is mounted onto the apparatus, the electric potential of the dielectric belt located in the toner transfer position is set to approximately 900V before running, but is lowered to approximately 500V after running, supposing that the electric potential of the dielectric belt is set to approximately 900V and it takes two seconds for the dielectric belt to be carried from the charging roller 70 to the transfer position. When the electric potential of the dielectric belt is lowered, the effective electric potential difference between the sheet 100 and the OPC drums is also lowered, so there is a problem that the transfer efficiency is lowered, depending on the apparatus running time (operation time).

Additionally, the tandem type color electro-photographic process contains many components, viewing from its characteristics that four image forming process units are parallel-disposed therein. For example, a general tandem type color electro-photographic process contains four sets of photosensitive bodies, photosensitive body chargers (containing the power source), exposure units, developing units, photosensitive body cleaning blades, transfer units (containing the power source), etc., respectively. Therefore, there is a problem that the tandem type color electro-photographic process is produced at higher costs than other color electrophotographic processes.

To reduce the number of components, it is considered as an example that a transfer power source should be used commonly. However, as explained above, when the electric potential of the dielectric belt is set to a high electric potential such as 1000V, etc., there are various electric potential differences between the front and back faces of the dielectric belt in the four-color transfer positions because of the material of the dielectric belt, the lowering of the surface-resistance value of the dielectric belt after running, the injection of electric charges from the photosensitive body into the dielectric belt. Therefore, the transfer efficiencies of the respective colors may be different from each other, when a voltage is applied from the same power source to the transfer unit.

FIG. 9 conceptually shows the result of measuring the transfer efficiency when the transfer voltage of each color is changed, in the case that the belt 50 is charged to approximately 1200V. As shown in FIG. 9, when the transfer voltages of all the colors are set to 1000V, the Magenda-, Cyan-, and Black-color toner transfer efficiencies are 100%, but the Yellow-color toner transfer efficiency is 80%. Therefore, there is a problem that the transfer power source could not be used commonly and the apparatus could not be produced at lower costs.

SUMMARY OF THE INVENTION

It is an object of the present invention to provide a color image forming apparatus and a color image forming method thereof, which enable a tandem type engine to be produced at lower costs.

It is another object of the present invention to provide a color image forming apparatus and a color image forming method thereof, which prevent the transfer efficiency from being lowered by running.

It is yet another object of the present invention to provide a color image forming apparatus and a color image forming method thereof, which enable a transfer power source to be commonly used and the apparatus to be produced at lower costs.

To attain the above objects of the present invention, a color image forming apparatus for forming a multi-color toner image to be a color image on a transfer material, or a color image forming method thereof comprises a plurality of image forming units for transferring toner images with different colors from an image carrier onto the transfer material, a dielectric belt for carrying the transfer material to sequentially pass the plurality of image forming units, a charging member for charging the transfer material to adsorb the transfer material onto the dielectric belt, and an electric potential setting member for setting the electric potential of the dielectric belt before the adsorption so as to prevent the electric potential difference between the front and back faces of the dielectric belt to affect each of the transfer operations.

According to the present invention, the electric potential difference between the front and back faces of the dielectric belt in the tandem type image forming unit can be set to approximately 0V before the dielectric belt adsorbs the transfer material so that the resistance value of the dielectric belt cannot affect the transfer operation. This enables the electric potential difference between the front and back faces of a dielectric belt to be set to approximately 0V in the respective toner color transfer positions. Therefore, there is a wide range of selecting the dielectric belt types, and the lowering of the transfer efficiency can be prevented, which is caused by the lowering of the surface-resistance of the dielectric belt after running.

According to the present invention, preferably by commonly using a transfer power source for transferring different color toners as well as by setting the above electric potential, the irregularities in the transfer efficiencies of the respective toner colors can be prevented, which are generated when the same transfer power source is commonly used, as well as the apparatus can be produced at lower costs.

Furthermore, according to the present invention, the transfer efficiencies of all toner colors can be set to appropriate values, preferably by setting the voltage applied from the above transfer power source so that the electric potential difference between the latent image and the transfer medium surface can be set between 1100V and 2600V.

DESCRIPTION OF THE PREFERRED EMBODIMENTS

Figure 1:
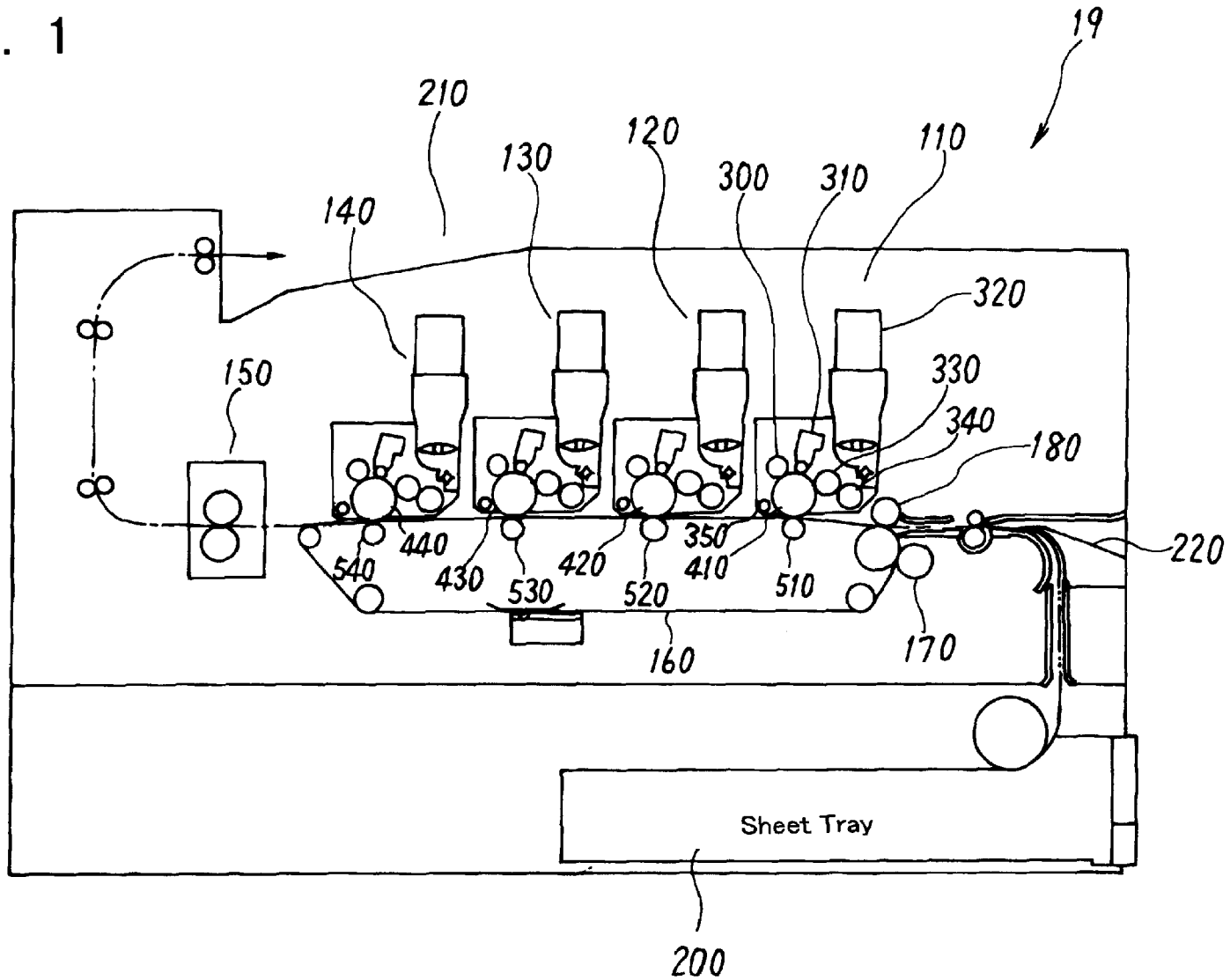
FIG. 1 is the constitutional view of a color image forming apparatus as an embodiment of the present invention.
Figure 2:
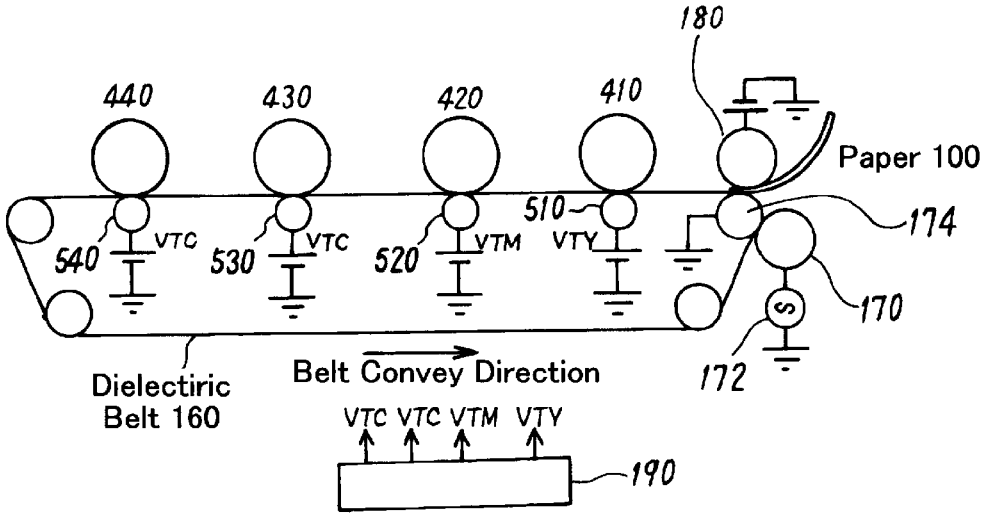
FIG. 2 is the transverse sectional view of the transfer mechanism in FIG. 1.

FIG. 1 is a constitutional view of a color image forming apparatus as an embodiment of the present invention, and FIG. 2 is a transverse sectional view of the transfer mechanism in FIG. 1.

As shown in FIG. 1, a tandem type color image forming apparatus 19 comprises four image forming units 110, 120, 130, and 140. The image forming unit 110, 120, 130, or 140 is an electrophotographic unit comprising a photosensitive drum 410, 420, 430, or 440, a photosensitive body charger (containing a power source thereof) 300, an exposure unit 310, developing units 330 and 340, a photosensitive body cleaning blade 350, a transfer unit (containing a power source thereof) 510, 520, 530, or 540. A toner bottle 320 for supplying toners with different colors to the developing unit is disposed in each of the four image forming units 110, 120, 130, and 140. For example, the Yellow-, Cyan-, Magenda-, and Black-color toners are contained in the toner bottles 320, respectively.

A sheet 100 as a transfer material is fed from a sheet feeding tray 200 or a manual insertion port 220. A sheet adsorption roller 180 for charging the sheet 100, an dielectric belt 160 such as PVDF, etc. for carrying the sheet 100, and an electric potential setting roller 170 for setting the electric potential difference between the front and back faces of the dielectric belt 160 to approximately 0V before adsorbing the sheet 100 are disposed in the tandem type color image forming apparatus 19. A fixing unit 150 thermal-fixes a toner image on the sheet 100, which has passed the image forming units 110, 120, 130 and 140. A stacker 210 accommodates the sheet 100 after the toner image is thermal-fixed thereon.

FIG. 2 explains a color image forming process. In FIG. 2, reference numbers 410, 420, 430, and 440 indicate OPC (Organic Photoconductor) drums as photosensitive drums in the Yellow-, Magenta-, Cyan- and Black-color image forming process units 110, 120, 130, and 140, respectively, and reference numbers 510, 520, 530, and 540 indicate transfer rollers thereof.

An electrical latent image is formed on each of the OPC drums 410, 420, 430, and 440, as explained below. However, this latent image forming process is explained, taking an example of using minus-charged toners. The OPC drum is charged by the charger 300, but in this embodiment, a brush charger is used. The OPC drums are charged up to −700V by the conductive brush 300.

Then, an image formed portion on each of the OPC drums is exposed by light image, using an exposure unit 310 such as an LED array head, and the electric potential is lowered up to approximately −100V. The developing unit (developing roller) 330 in FIG. 1 develops the electrostatic latent image formed on each OPC drum, using the minus-chargedone-component Yellow-, Magenta-, Cyan- and Black-color toners. The developed toner image is transferred onto the sheet 100 to be carried, with a strength received from an electric field, which is generated between the OPC drums and the sheet with a voltage applied from the transfer units 510, 520, 530, and 540 such as transfer rollers.

This sheet 100 is charged by a sheet adsorption roller 180, and adsorbed onto the dielectric belt 160. The dielectric belt 160 is charged by the effects obtained from the sheet adsorption process, the four-color toner transfer process units, etc. However, in this embodiment, for example, the dielectric belt 160 is charged to 0V by the electric potential setting unit 170 such as an electricity discharging brush 170, etc. In this embodiment, the electricity discharging brush 170 is constituted of a conductive brush disposed around the SUS core metal. A voltage Vpp of 2 kV is applied with a frequency of 800 Hz in the "sin" wave (alternating current) from a voltage source 172 to the electricity discharging brush 170. A voltage of 500V (direct current) is applied to the sheet absorption roller 180.

In this embodiment, the transfer members 510, 520, 530, and 540 for transferring the Yellow-, Magenda-, Cyan- and Black-color toners are used as transfer rollers, and a transfer voltage is set to the same value in a range of 500 to 2000V for each of the Yellow, Magenda, Cyan, and Black colors.

Figure 4:
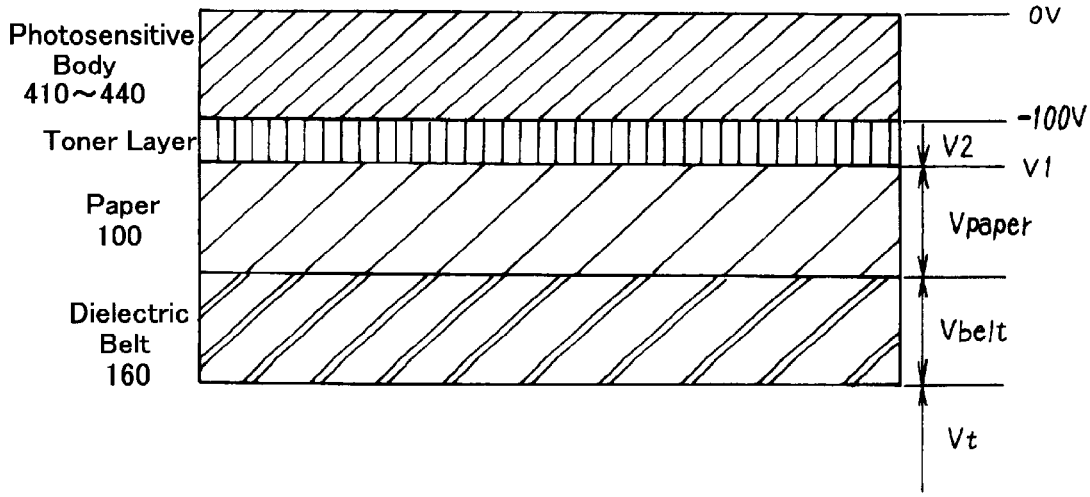
FIG. 4 is the explanatory view of the transfer model in FIG. 2.
Figure 5:
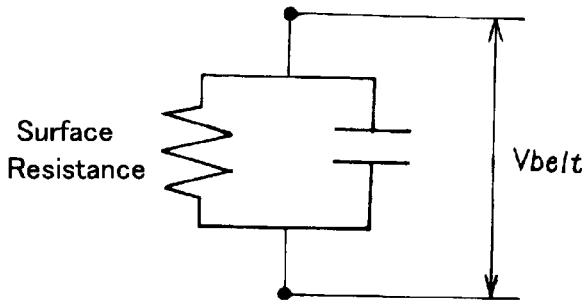
FIG. 5 is the equivalent circuit diagram of the dielectric belt in FIG. 2.

The action of setting an electric potential of the front or back face of the dielectric belt 160 is explained, referring to FIGS. 4 and 5. FIG. 4 typically shows an example of the relationship in electric potential of the transfer process, when the transfer process is executed with minus-charged toners. In this example, "Vt" is the transfer voltage, "Vbelt" is the electric potential difference between the front and back faces of the dielectric belt, "Vpaper" is the potential difference between the front and back faces of the sheet, "V1" is the electric potential of the sheet surface and "V2" is the electric potential difference between the photosensitive body's surface and the sheet surface. The toner layer on the photosensitive body is transferred onto the sheet through an electric field generated by "V2" as an electric potential difference between the photosensitive body's surface and the sheet surface.

Supposing that Vpaper=200V, Vbelt=1000V, and Vt=−100V are given, the electric potential of the sheet surface V1 is represented as follows:

$$V1=Vt+V\text{belt}+V\text{paper}=1100\text{V}$$

Therefore, the electric potential difference "V2" between the photosensitive body's surface and the sheet surface is represented below, considering the electric potential on the photosensitive body's surface as the reference electric potential:

$$V2=1100-(-100)=1200\text{V}$$

The toners on the photosensitive body are transferred onto the sheet 100 through an electric field generated by the above electric potential difference "V2."

Figure 8:
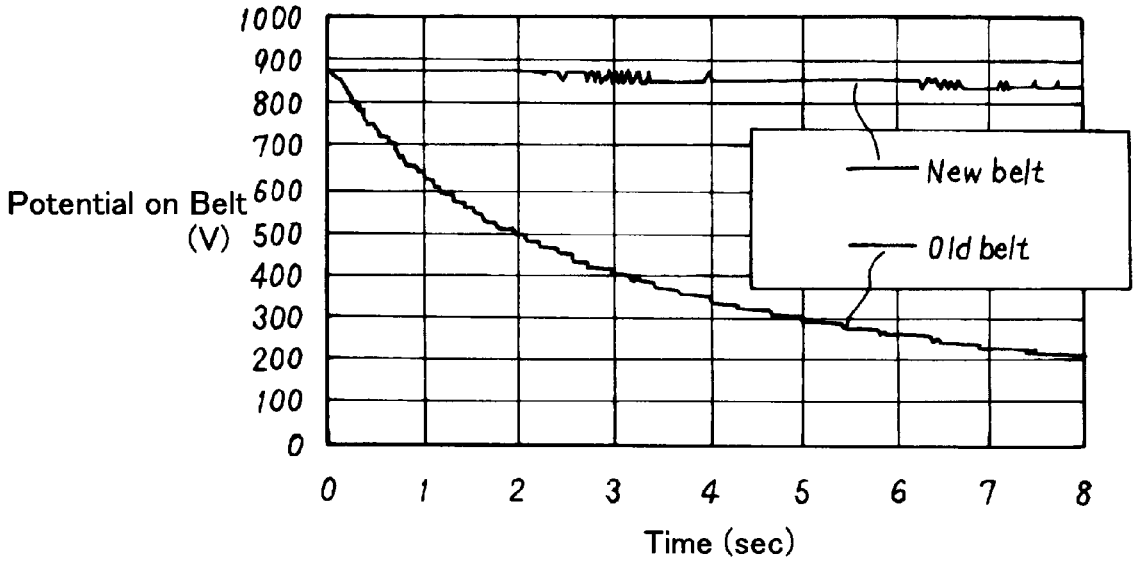
FIG. 8 Prior Art
FIG. 8 is the explanatory view of the electric potential fluctuations after the running in the prior art.
Figure 9:
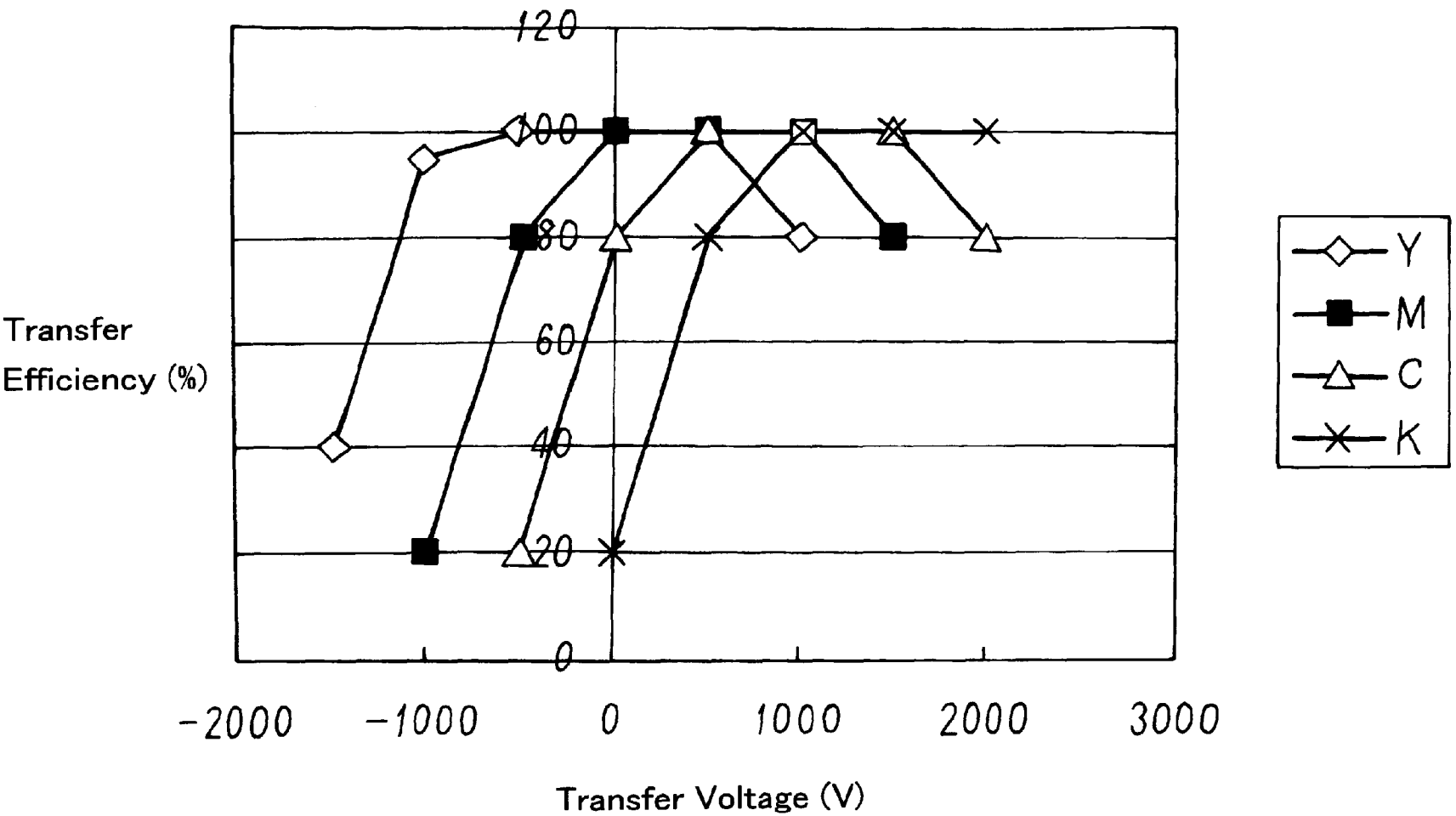
FIG. 9 Prior Art
FIG. 9 shows the relationship between the transfer voltage and the transfer efficiency in the prior art.

FIG. 5 is an equivalent circuit diagram of the dielectric belt 160 in FIG. 4. After running, the resistance value of the surface of the dielectric belt 160 is lowered by the adhesion of impurities such as toners onto the dielectric belt 160, etc. At the result, when the dielectric belt 160 is charged with electricity as conventional, as shown in FIG. 8, the electric potential of the surface of the dielectric belt 160 is lowered earlier, compared to that of the dielectric belt 160 before running.

Figure 3:
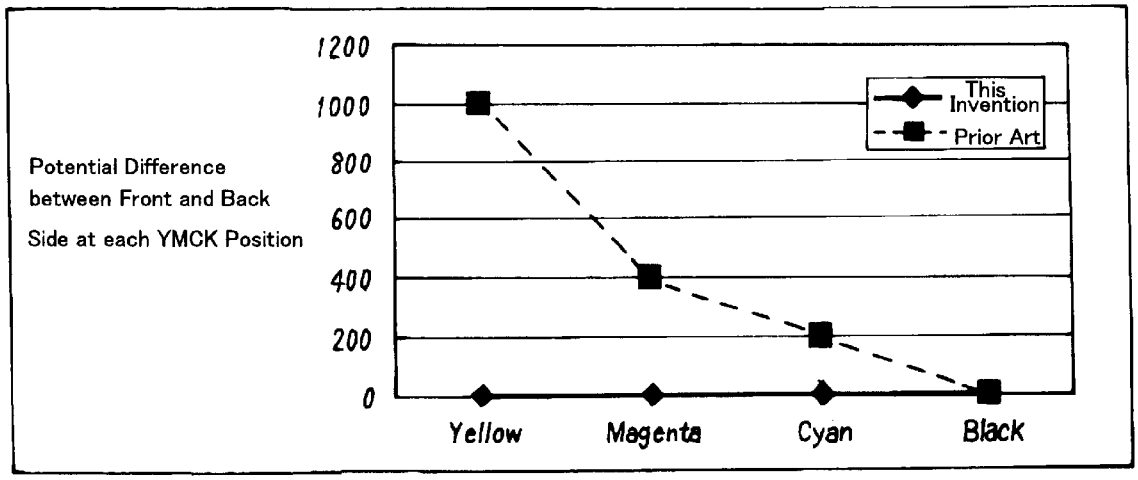
FIG. 3 is the explanatory view of the electric potential difference between the front and back faces of the dielectric belt in each transfer position of the present invention.

According to the present invention, as shown in FIG. 3, the electric potential difference "V2" between the sheet surface and the photosensitive body's surface is not changed even when the resistance value of the surface of the dielectric belt 160 is lowered after running, because the electric potential difference between the front and back faces of the dielectric belt 160 is set to 0V.

In the prior art, the different transfer voltage "Vt" is set for each color. However, according to the present invention, the transfer voltages "Vbelt" in FIG. 4 are set almost same in the transfer positions of the respective colors by setting the electric potential difference between the front and back faces of the dielectric belt 160 to 0V, so the transfer voltage "Vt" can be set to the same value for each color. Taking the model in FIG. 4, the transfer voltages "Vt" (VTY, VTM, VTC, VTB) of all the colors can be set to 900V, because the electric potentials "V1" of the sheet surfaces with all the colors are set to 1100V, when the electric potentials of the front and back faces of the dielectric belt 160 are set to 0V by the electricity discharging brush 170.

Figure 6:
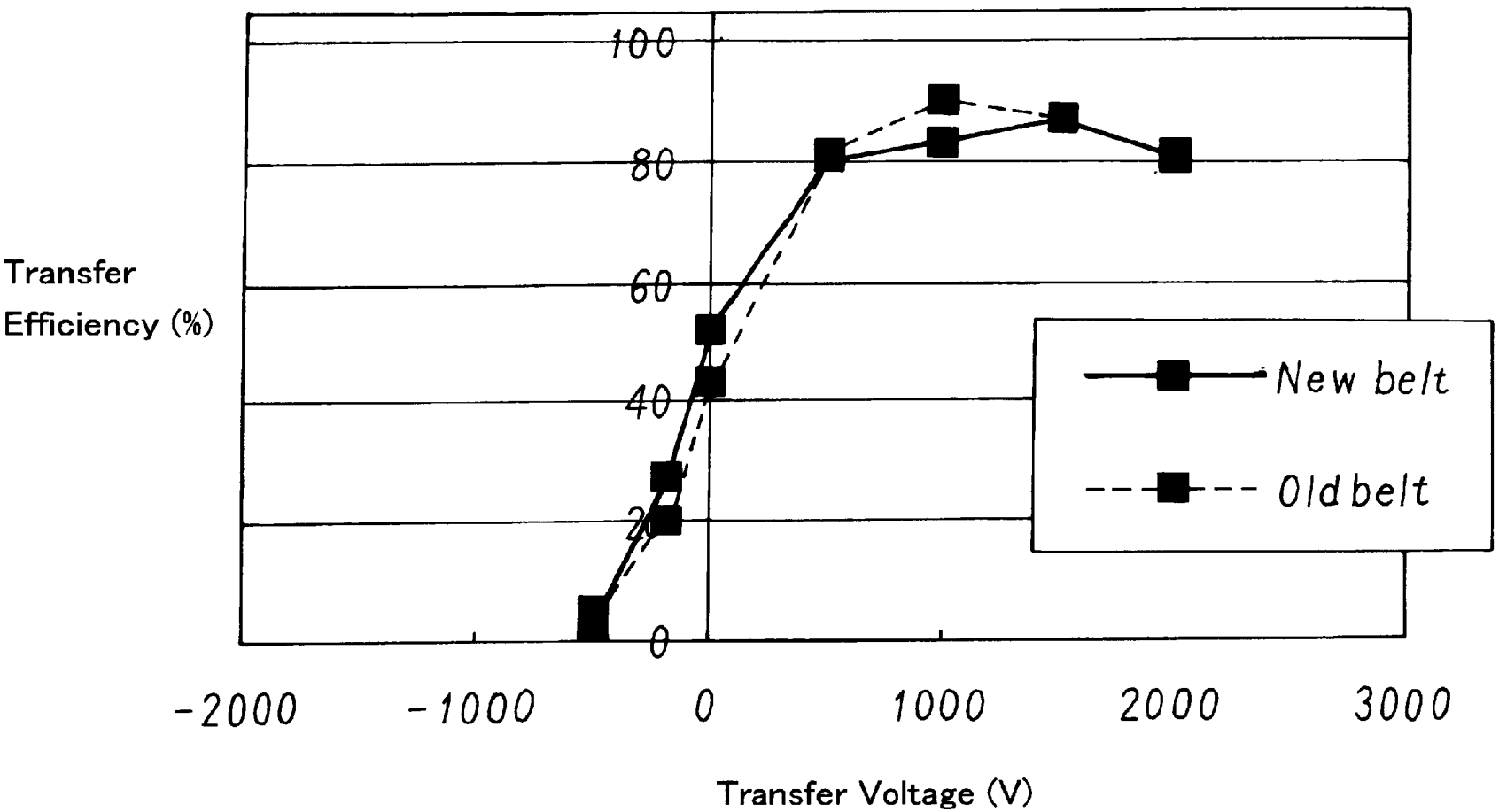
FIG. 6 shows the relationship between the transfer voltage and the transfer efficiency in the present invention.
Figure 7:
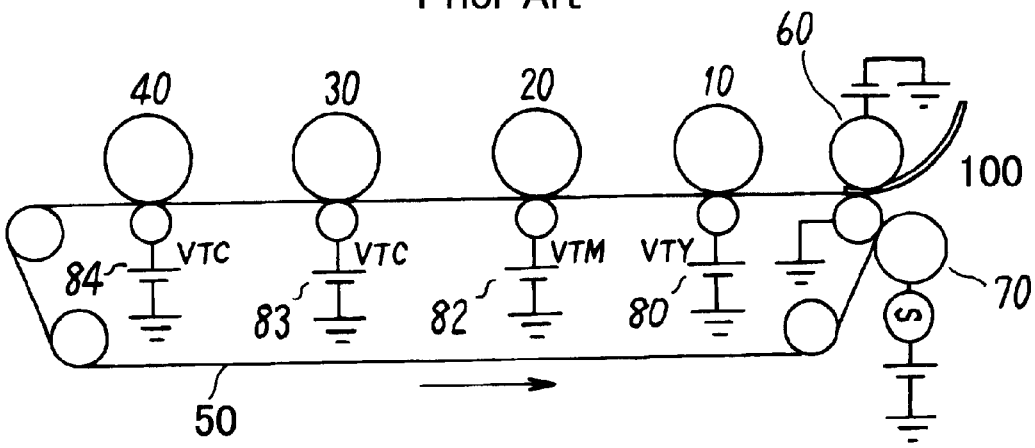
FIG. 7 Prior Art
FIG. 7 is the explanatory view of the prior art.

Then, the optimal range of transfer voltages "Vt" is explained, referring to FIG. 6. FIG. 6 shows the result of measuring the transfer efficiency when the transfer voltage is changed from −500V to 2000V, supposing that the electric potential of the dielectric belt is set to 0V before the sheet is adsorbed thereto, as well as shows the relationship in transfer efficiency between the new belt and the old belt used for running. It is judged from the result of FIG. 6 that the transfer voltage ranges from 500V to 2000V when the generally admitted transfer efficiency is 80% or more.

When being converted to the transfer voltage into the electric potential difference between the OPC drums and the developing roller, the ranges of the electric potential difference become from 600V to 2100V, because the electric potential of the electrostatic latent image is −100V. At this time, the sheet is charged so that the electric potential difference between the back and front faces thereof can be set to 500V, and therefore the electrical potential difference ranges from 1100V to 2600V, depending on the electric potential difference between the sheet surface and the latent image.

According to this embodiment, the lowering of the belt's electric potential, which is caused by the lowering of the electric charge carrying ability during running, can be prevented by presetting the electric potential difference between the front and back faces of the dielectric belt 160 to 0V with the electric potential setting unit. This prevents the effective electric potential difference between the sheet and the OPC drums from being lowered by running, so the transfer efficiency can be rarely lowered. Additionally, the electric potentials of the transfer positions for the respective colors are set almost same on the sheet by setting the electric potential difference between the front and back faces of the dielectric belt 160 to 0V, so that a transfer power source 190 can be used as a common power source, as shown in FIG. 2. Therefore, a color image forming apparatus can be produced at lower costs.

The dielectric belt can be made of PVDF, polyimide, ETFE, polycarbonate, etc., and the image forming unit is not limited to the electrophotographic unit. Additionally, this embodiment has been explained above, taking the example in which the electric potential difference between the front and back faces of the dielectric belt 160 is set to 0V by the electric potential setting unit. However, this electric potential difference need not be set accurately to 0V, which is favorably set in the range that the resistance value of the dielectric belt does not affect the electric potential difference between the sheet surface and the photosensitive body's surface.

The electric potential difference between the front and back faces of the electric belt before adsorbing the sheet is set to approximately 0V, so that it can be prevented that the belt material affects the transfer efficiency and that the transfer efficiency is lowered by running.

Additionally, when the transfer voltage is set to the same value for each color, the transfer efficiencies of the respective colors can be set almost same by setting the electric potential difference between the front and back faces of the dielectric belt to approximately 0V.

Additionally, a transfer efficiency over 80% can be obtained by setting the electric potential difference between the front and back faces of the dielectric belt to 0V and by setting the electric potential difference between the transfer material surface and the electrostatic latent image in the range of 1100 to 2600V.

While the present invention has been particularly shown and described with reference to one preferred embodiment thereof, it will be understood by those skilled in the art that the foregoing and other changes in form and details can be made therein without departing from the spirit and scope of the present invention.

What is claimed is:

1. A color image forming apparatus for forming a multicolor toner image on a transfer material, comprising:

a plurality of image forming units, each unit transfer a different color toner images each other from an image carrier onto the transfer material;

a dielectric belt for carrying the transfer material to sequentially pass the plurality of image forming units;

a charging means for charging the transfer material to adsorb the transfer material onto the dielectric belt; and an electric setting means for setting an electric potential difference of the dielectric belt before the adsorption to no electric potential difference between the front and back faces of the dielectric belt to affect each of the transfer operations.

2. The color image forming apparatus of claim 1, wherein the electric potential setting means sets the front and back faces of the dielectric belt to approximately 0V.

3. The color image forming apparatus of claim 1, wherein each of the plurality of image forming units has a transfer means for transferring the toners of the image carrier onto the transfer material, and wherein said apparatus has a transfer power source for commonly supplying the transfer voltage of the transfer means of each image forming unit.

4. The color image forming apparatus of claim 3, wherein the transfer voltage is set so that the electric potential difference between the latent image of the image carrier and the transfer material be set between 1100V and 2600V.

5. The color image forming apparatus of claim 1, wherein the electric potential setting means comprises an electricity discharging means for discharging the electricity with an alternating current.

6. The color image forming apparatus of claim 5, wherein the electricity discharging means has a discharging brush.

7. A color image forming method for forming a multicolor toner image on a transfer material, comprising the steps of:

charging the transfer material to absorb the transfer material onto a dielectric belt;

setting an electric potential of the dielectric belt before the adsorption to no electric potential difference between the front and back faces of the dielectric belt to affect each of the transfer operations; and carrying the transfer material with the dielectric belt so that the transfer material can sequentially pass a plurality of image forming units for transferring toner images with different colors from an image carrier onto the transfer material.

8. The color image forming method of claim 7, wherein the electric potential setting step sets the front and back faces of the dielectric belt to approximately 0V.

9. The color image forming method of claim 7, further comprising the step of:

commonly supplying the transfer voltage to the transfer means for transferring the toners of the respective image carriers in the plurality of image forming units, onto the transfer material.

10. The color image forming method of claim 9, wherein the transfer voltage is set so that the electric potential difference between the latent image of the image carrier and the transfer material be set between 1100V and 2600V.

11. The color image forming method of claim 7, wherein the electric potential setting step includes the step of discharging the electricity with an alternating current.

12. The color image forming method of claim 11, wherein the electricity discharging step discharges the electricity with an electricity discharging brush.

* * * * *